United States Patent [19]

Cousins

[11] Patent Number: 4,803,751

[45] Date of Patent: Feb. 14, 1989

[54] SCRAPER

[76] Inventor: Morison Cousins, 229 E. 28th St., New York, N.Y. 10016

[21] Appl. No.: 73,988

[22] Filed: Jul. 16, 1987

[51] Int. Cl.[4] ..... A47L 13/02

[52] U.S. Cl. ..... 15/236.05; 30/169; 30/330

[58] Field of Search ..... 15/236; 206/229, 349; 30/169, 172, 164, 330, 151, 153, 329, 340, 342

[56] References Cited

U.S. PATENT DOCUMENTS

| | | | |
|---|---|---|---|
| 2,326,502 | 8/1943 | Sieg . | |
| 2,635,334 | 4/1953 | Tvrzicky . | |
| 2,880,505 | 4/1959 | Geery . | |
| 3,087,243 | 4/1963 | Matousek . | |
| 3,157,946 | 11/1964 | Smecko . | |
| 3,670,414 | 6/1972 | Stecker . | |
| 3,771,225 | 11/1973 | Unger . | |
| 3,793,726 | 2/1974 | Schrank . | |
| 3,899,828 | 8/1975 | Bosco . | |
| 4,017,970 | 4/1977 | Williams . | |
| 4,182,033 | 1/1980 | Jacobson et al. . | |
| 4,189,829 | 2/1980 | Iten et al. | 30/351 |

FOREIGN PATENT DOCUMENTS

| | | | |
|---|---|---|---|
| 1801607 | 5/1970 | Fed. Rep. of Germany . | |
| 2085789 | 5/1982 | United Kingdom | 15/236 R |

*Primary Examiner*—Timothy F. Simone
*Assistant Examiner*—J. Dwight Poffenberger, Jr.
*Attorney, Agent, or Firm*—Amster, Rothstein & Ebenstein

[57] ABSTRACT

A scraper may be composed of a front portion, including a guard portion, hingeably connected to a handle portion. The handle portion includes a blade portion for receiving and retaining a cutting blade. The front portion is scored to allow the guard portion to fold against the top face of the handle portion, thereby substantially enclosing the blade and acting to provide protection for various objects and personnel from inadvertent contact with the sharp cutting blade when the scraper is not in use. When use of the scraper is desired, the front portion is folded against the bottom face of the handle portion thereby exposing the cutting edge of the blade.

24 Claims, 2 Drawing Sheets

FIG. 6.
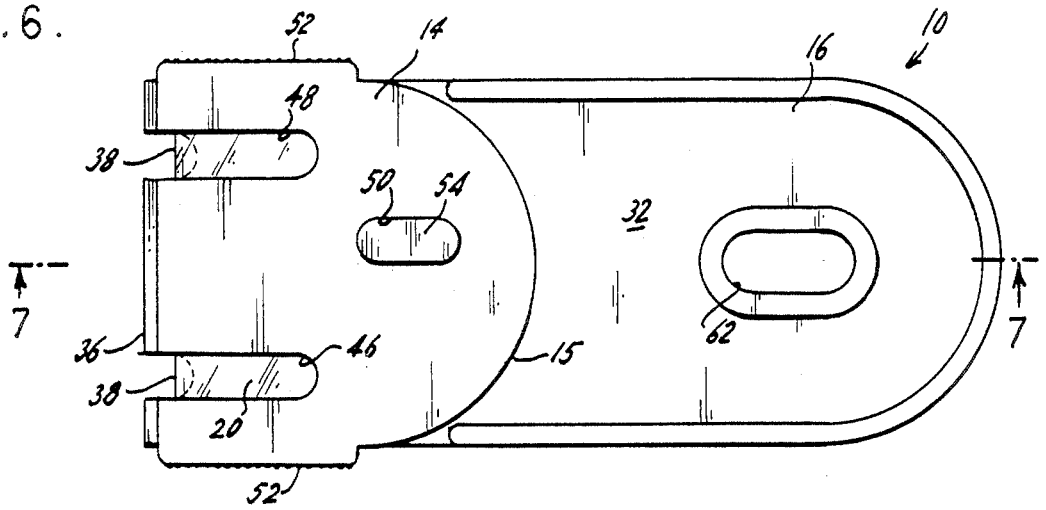
FIG. 7.
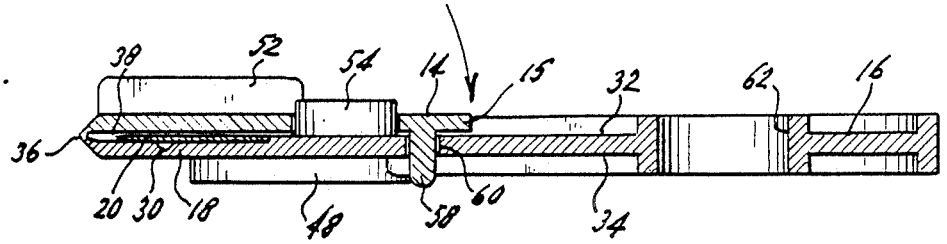
FIG. 5.
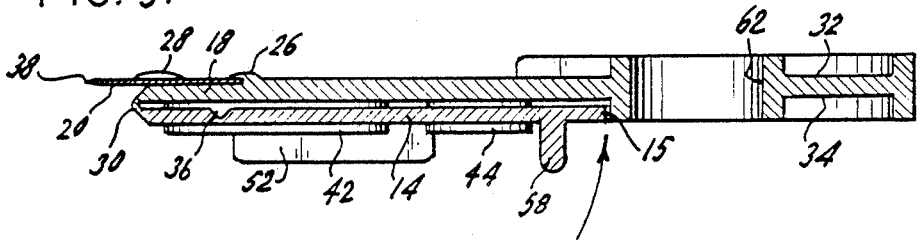
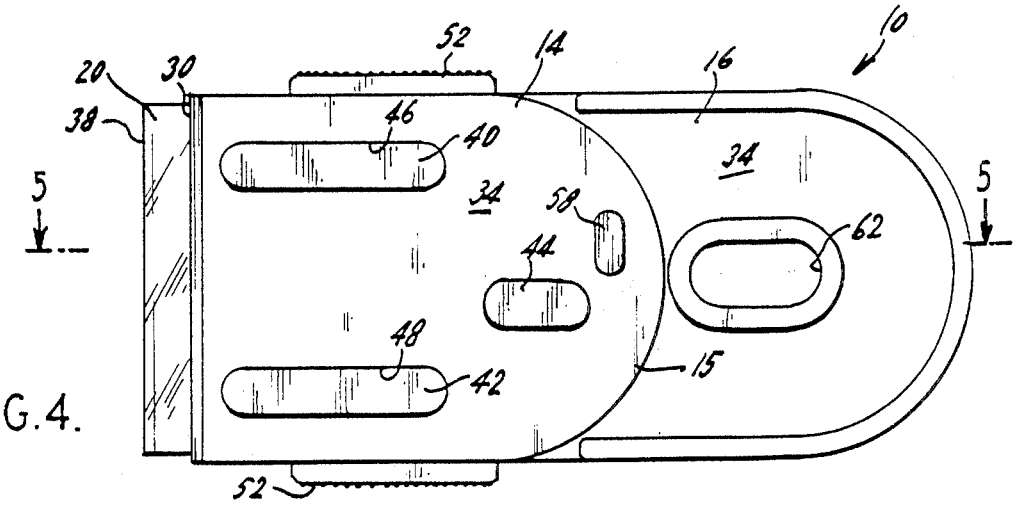
FIG. 4.

SCRAPER

BACKGROUND OF THE INVENTION

The present invention relates to cutters and scrapers, and more particularly to such devices, having guards, that can be disposable and consist of one piece in manufacture and in use.

Cutters and scrapers are generally well known in the art and in basic form include a handle having a blade. The cutting edge of the blade is brought to bear against a surface sought to be scraped clean, as in the case of removing a sticker or paint from glass, or removing peeling paint from a surface, etc. Because the edge of the blade is sharp, care must be exercised to prevent the edge from inflicting harm to personnel and articles which might come in contact with the edge.

Cutters and scrapers which possess guards for cutting or scraping edges thereof are known; however, none are disposable and comprise a unibody construction in manufacture and in use. U.S. Pat. No. 4,189,829 to Iten et al., for example, discloses a razor blade package and guard. However, the apparatus incorporates a score line for separation of the guard portion from the handle portion resulting in two (2) portions. U.S. Pat. No. 4,182,033 to Jacobson et at. is bulky, is produced in several pieces rather than a single piece, and the guard portion is detachably removed from the blade portion. U.S. Pat. No. 3,793,726 to Schrank teaches a disposable scalpel having a detachable guard. However, once removed the guard is, in fact, never used, except for blade coverage upon disposal. In U.S. Pat. No. 3,899,828 to Bosco, a component is used for either holding or guarding a blade.

Accordingly it is an object of the present invention to provide a scraper that is disposable.

Another object of the present invention is to provide a scraper which may be formed in a single molding operation.

Still another object of the present invention is to provide a scraper, including a guard portion, comprising a unibody construction in manufacture and in use.

Still yet another object of the present invention is to provide a scraper having a gripping means being integrally formed with the guard.

SUMMARY OF THE INVENTION

In accomplishing these and other objects in accordance with the preferred embodiment, a scraper may be composed of a front portion, including a guard portion, hingeably connected to a handle portion. The handle portion includes a blade portion for receiving and retaining a cutting blade. The front portion is scored to allow the guard portion to fold against the top face of the handle portion, thereby substantially enclosing the blade and acting to provide protection for various objects and personnel from inadvertent contact with the sharp cutting blade when the scraper is not in use. When use of the scraper is desired, the front portion is folded against the bottom face of the handle portion thereby exposing the cutting edge of the blade.

Further objects, features and advantages of the present invention will be more readily appreciated by reference to the following detailed description when taken in conjunction with the accompanying drawings. It is to be understood that the drawings are designed for the purpose of illustration only and are not intended as a definition of the limits of the invention.

BRIEF DESCRIPTION OF THE DRAWINGS

In the drawings, wherein similar referenced characters denote similar elements throughout the several figures:

FIG. 4 is a bottom plan view of the disposable scraper of FIG. 1, with the blade intact, shown in an open and locked position;

FIG. 5 is a sectional side elevation view of the disposable scraper of FIG. 1 taken along line 5—5 of FIG. 4;

FIG. 6 is a top plan view of the disposable scraper of FIG. 1, with the blade intact, shown in a closed and locked position; and FIG. 7 is a sectional side elevation view of the disposable scraper of FIG. 1 taken along line 7—7 of FIG. 4.

DETAILED DESCRIPTION OF THE PREFERRED EMBODIMENT

Figure 1:
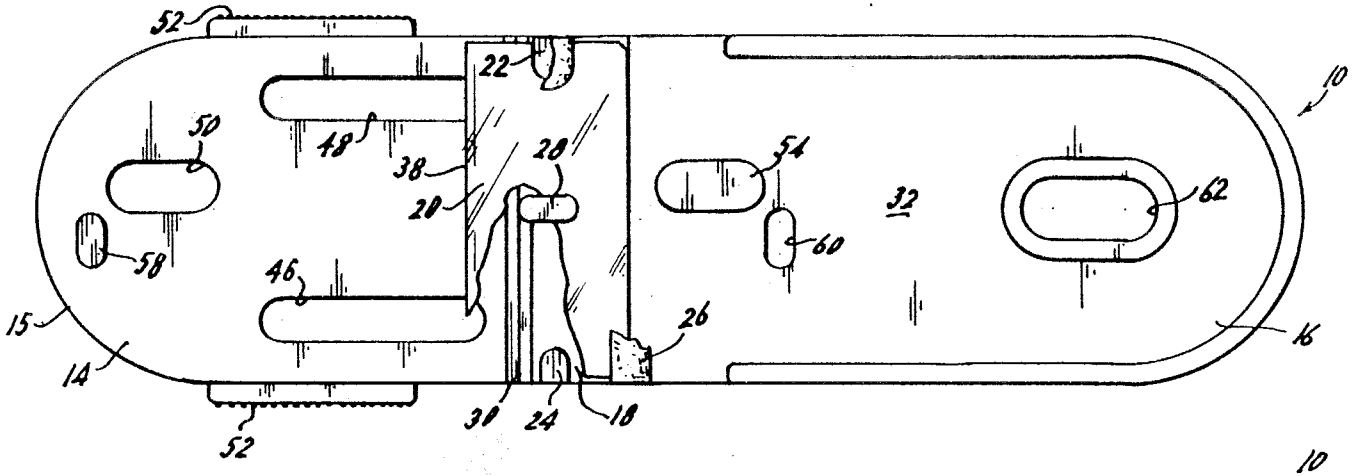
FIG. 1 is a top plan view of a preferred embodiment of the disposable scraper of the present invention with the blade partially broken away.
Figure 2:
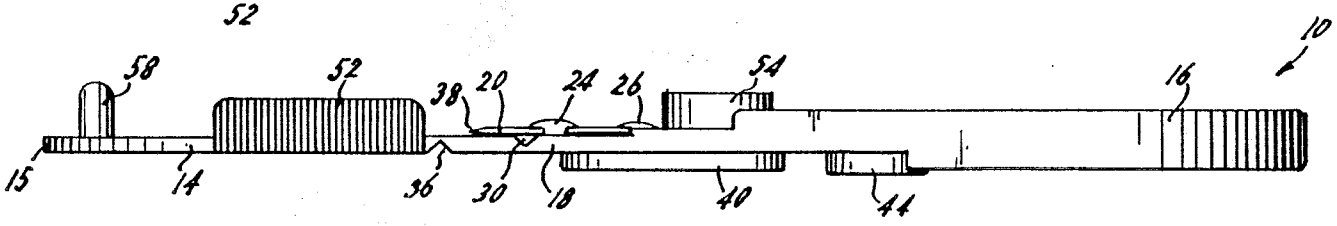
FIG. 2 is a side elevation view of the disposable scraper of FIG. 1 with the blade intact.

Referring to FIGS. 1–7, a scraper incorporating one embodiment of the present invention is identified generally by the reference numeral 10. The scraper 10 is produced of but a single piece and includes a front portion 14 hingeably connected to a handle portion 16. The front portion 14 includes a guard portion 15 and the handle portion 16 includes a blade portion 18 for receiving and retaining a blade 20 having an edge 21. The scraper 10 includes a top face 32 and a bottom face 34.

The blade 20 is preferably a single edge razor blade although other types of blades having sharp cutting edges may be used. The scraper 10 is preferably, but not exclusively, made of a flexible plastic material. It is extremely simple and inexpensive to manufacture; requiring production of but a single piece, such as by for example, injection molding. Thus, the inexpensive nature of the scraper allows it to be disposed of when the blade becomes worn and dull. Of course, other materials and methods of manufacture can be employed that do not deter from the spirit and scope of the present invention.

The blade portion 18 retains the blade 20 by the process of heat sealing. Before the blade 20 is heat sealed, blade 20 is received in the blade portion 18 by fitting within tabs located at heat sealing points 22, 24, 26 and 28 (not shown). Heat sealing is accomplished by hot pressing the tabs until they "mushroom" over the blade 20 thereby tacking the blade 20 in the blade portion 18. The blade 20 and the heat sealing points 22, 26 and 28 in FIG. 1, are partially broken away to illustrate the extent to which the tabs "mushroom" over the blade 20 after they have been hot pressed. This can also be seen in FIG. 2 whereby the heat sealing points 24 and 26 are shown to be tracking down the blade 20. For aesthetic purposes, a plastic overlay may be employed when hot pressing the tabs. As a result, after heat sealing, a uniform layer of plastic will cover blade 20 and conceal the, otherwise visible, mushroomed tabs. Even though heat sealing is the preferred method of retaining the blade 20 in the blade portion 18, it will be readily apparent to those skilled in the art that any method can be employed as long as it securely retains the blade 20 to the blade portion 18 whether such method results in permanent or temporary retention of the blade 20 in the blade portion 18. Examples of such methods include the use of glue, screw and nut assemblies, etc. Of course, the method used will relate to the type of material used in the construction of the scraper 10.

The front portion 14 is hingeably connected to the handle portion 16 by a first hinge 30. The first hinge 30 is formed by scoring a V-shaped notch across the width of the top face 32 of the scraper 10. The first hinge 30 may be formed by any of the known techniques. The first hinge 30 allows the bottom face 34 of the front portion 14 to be rotated in the direction of, or folded against, the bottom face 34 of the handle portion 16 when use of the scraper 10 is desired. A second hinge 36 is located between the guard portion 15 and the first hinge 30 and formed by scoring a V-shaped notch across the width of the bottom face 34 of the front portion 14. Like the first hinge 30, the second hinge 36 may be formed by any of the known techniques. The second hinge 36 allows the top face 32 of the guard portion 15 to be rotated in the direction of, or folded against, the top face 32 of the handle portion 16 when the scraper 10 is not in use. As a result, the blade 20 and the edge 38 are substantially enclosed by the guard portion 15 thereby providing protection to various objects and personnel from inadvertent contact with the sharp edge 21.

Figure 3:
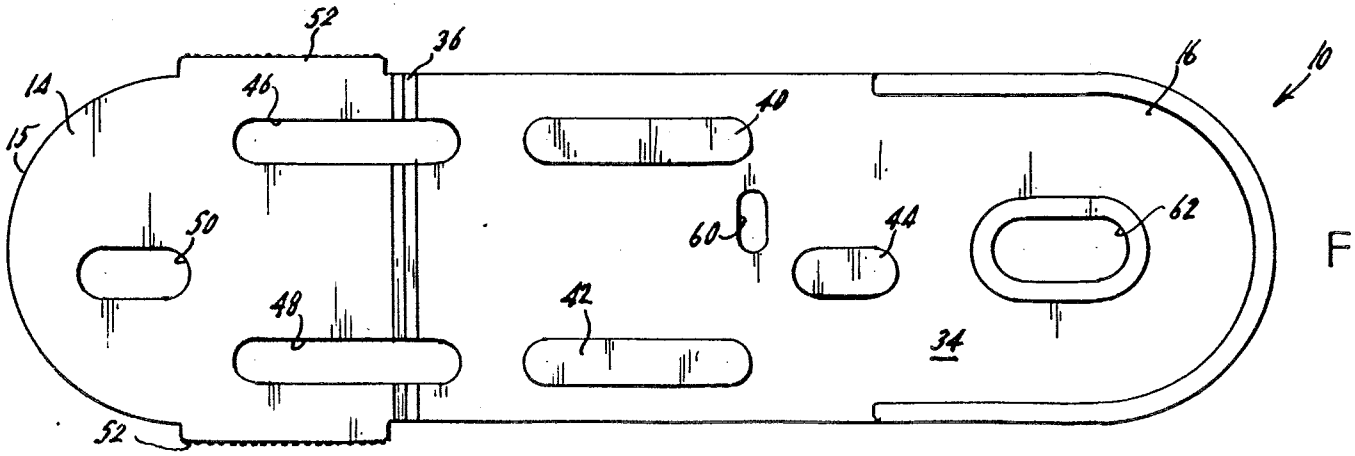
FIG. 3 is a bottom plan view of the disposable scraper of FIG. 1.

When use of the scraper 10 is desired, exposure of the edge 21 of the blade 20 is effectuated by engaging the scraper 10 to an open position. Referring now to FIGS. 3–5, to expose the edge 38 and engage the scraper 10 to an open position, the front portion 14 is folded back, along the first hinge 30, until its bottom face 34 lies against the bottom face 34 of the handle portion 16. To secure the front portion 14 and the handle portion 16 in this position, locking members are provided. Such locking members comprise bosses 40, 42 and 44 and corresponding holes 46, 48 and 50, adapted to receive and retain said bosses through a friction or interference fit.

FIGS. 4 and 5 show the scraper 10 in the locked and open position. The bottom face 34 of the front portion 14 is folded against the bottom face 34 of the rear portion 16 and the holes 40, 42 and 44 securely retain the bosses 46, 48 and 50. The edge 21 of the blade 20 is exposed and the scraper 10 is now ready for use. The front portion 14 is additionally provided with gripping means 52 which allow a user, in conjunction with the handle portion 16, to obtain a firm grip on the scraper 10 when it is in use.

When the scraper 10 is not in use and needs to be stored or put away, (or when the blade 20 becomes dull and the scraper 10 is to be discarded), the scraper 10 is to be engaged in the closed and locked position. Referring now to FIGS. 1, 2, 6 and 7, to engage the scraper 10 in the closed position, the guard portion 15 of the front portion 14 is folded, along the second hinge 36, until the top face 34 lies against top face 32 of handle portion 16. To secure the guard portion 15 and handle portion 16 in this position, locking members are provided. Such locking members comprise a boss 54 and a hole 50, adapted to receive and retain the boss 54 through an interference or friction fit.

FIGS. 6 and 7 show the scraper 10 engaged in the closed and locked position. The top face 32 of the guard portion 15 is folded against the top face 32 of the handle portion 16. The hole 50 securely retains the boss 54. In this position the blade 20, including the edge 21, is substantially enclosed by the guard portion 15, thereby guarding, or acting to provide protection, to various objects and personnel from inadvertent contact with the sharp edge 38 of the blade 20.

Referring now to FIGS. 1–3 and 6, 7, the scraper 10 is provided with release members for disengaging the scraper 10 when in the closed and locked position of FIGS. 6 and 7. Such members comprise a tab 58 fixed to the guard portion 15 and a corresponding hole 60 in the handle portion 16. The hole 60 is adapted to receive and permit passage of the tab 58 through the bottom face 34 of the handle portion 16 when the scraper 10 is in the closed and locked position of FIGS. 6 and 7. When disengagement is desired, such as when the scraper 10 is to be used, all that is necessary to do is push on the tab 58. This results in the separation of the guard portion 15 from the handle portion 16. Further, the tab 58 may also aid in securing the scraper 10 in the closed and locked position by the hole 60 securely retaining tab 58 through a friction or interference fit. The handle portion 16 is also provided with a hole 62 which is used to store and display the scraper, such as, by for example, hanging.

As will be readily apparent to those skilled in the art, the invention may be used in other specific forms or for other purposes without departing from its spirit or central characteristics. The present embodiment is therefore to be considered as illustrative and not restrictive. The scope of the invention being indicated by the claims rather than by the foregoing description, and all embodiments which come within the range of equivalents of the claims are intended to be embraced.

What is claimed is:

1. A scraper comprising:

a front portion having a guard portion;

a handle portion having a top face, a bottom face and a blade portion which is adapted to receive and retain a blade on the top face;

a first hinge means for hingeably connecting said front portion to said blade portion; and a second hinge means affixed within said front portion between said blade portion and said guard portion to hingeably connect said guard portion to the remainder of said front portion;

said first hinge means permitting said front portion to fold in a first direction towards the bottom face of said handle portion, and said second hinge means permitting said guard portion to fold in a second direction towards the top face of said handle portion.

2. The scraper of claim 1 wherein said second hinge means permits said guard portion to fold, to a second position, against the top face of said handle portion, and said first hinge means permits said front portion to fold, to a first position, against the bottom face of said handle portion.

3. The scraper of claim 2 further comprising:

a blade received and retained by said blade portion.

4. The scraper of claim 3 wherein said blade is substantially enclosed by said guard portion when said guard portion is folded to a second position.

5. The scraper of claim 3 wherein an edge of said blade is exposed when said front portion is folded to a first position.

6. The scraper of claim 3 wherein said blade is heat sealed to said blade portion.

7. The scraper of claim 6 further comprising:

concealing means for concealing a portion of said blade when heat sealed to said blade portion.

8. The scraper of claim 2 wherein said front portion and said handle portion includes locking means for securing said front portion in said first position and said guard portion in said second position.

9. The scraper of claim 8 wherein said locking means comprises:

a boss fixed to the top face of said handle portion, and a corresponding opening in said front portion adapted to receive and retain said boss when said guard portion is folded to said second position; and a boss fixed to the bottom face of said handle portion and a corresponding opening in said front portion adapted to receive and retain said boss when said front portion is folded to said first position.

10. The scraper of claim 9 wherein said locking means further comprises:

releasing means for releasing said guard portion when said guard portion is folded to said second position.

11. The scraper of claim 10 wherein said releasing means comprises:

a tab fixed to the top face of said guard portion and a corresponding hole in said handle portion adapted to receive and permit passage of said tab through the bottom face of said handle portion when said guard portion is folded to said second position.

12. The scraper of claim 1 wherein said scraper is manufactured of a flexible material.

13. The scraper of claim 1 wherein said flexible material is molded plastic.

14. The scraper of claim 1 wherein said scraper is a single piece.

15. The scraper of claim 1 wherein said scraper is formed by injection molding.

16. The scraper of claim 1 wherein said front portion includes gripping means for gripping said scraper when said front portion is folded to said first position.

17. A scraper comprising:

an integrally molded unitary body having a top face and a bottom face, said body including a front portion including a guard portion;

a handle portion including a blade portion which is adapted to receive and retain a blade on the top face of said handle portion;

a blade received and retained by said blade portion;

a first hinge means for hingeably connecting said front portion to said blade portion;

a second hinge means included within said front portion between said blade portion and said guard portion to hingeably connect said guard portion to the remainder of said front portion;

said first hinge means permitting said front portion to fold to a first position against the bottom face of said handle portion to expose an edge of said blade, and said second hinge means permitting said guard portion to fold to a second position against the top face of said handle portion to substantially enclose said blade; and, a locking means for securing said front portion in the first position and said guard portion in the second position.

18. The scraper of claim 17 wherein said locking means comprises:

a boss fixed to the bottom face of said handle portion;

a corresponding opening in said front portion adapted to receive and retain said boss when said front portion is engaged in the first position;

a second boss fixed to the top face of the said handle position; and, a corresponding opening in said guard portion adapted to receive and retain said second boss when said guard portion is engaged in the second position.

19. The scraper of claim 17 wherein said locking means further includes releasing means for releasing said guard portion when said scraper is engaged in said second position.

20. The scraper of claim 19 wherein said releasing means comprises:

a tab fixed to the top of said front portion and a corresponding opening in said handle portion adapted to receive and permit passage of said tab through the bottom face of said handle portion when said guard portion is engaged in said second position.

21. The scraper of claim 17 wherein said front portion includes gripping means for gripping said front portion when engaged in the first position.

22. A scraper comprising:

an integrally molded unitary body having a top face and a bottom face, said body including a front portion including a guard portion;

a handle portion including a blade portion adapted to receive and retain a blade on the top face of said handle portion;

a blade received and retained in said blade portion;

a first hinge means for hingeably connecting said front portion to said blade portion to permit said front portion to fold in a first direction towards the bottom face of said handle portion to expose an edge of said blade; and a second hinge means included within said front portion and positioned beyond the edge of said blade between said blade portion and said guard portion to permit said guard portion to fold in a second direction towards the top face of said handle portion to substantially enclose the edge of said blade.

23. A scraper comprising:

a front portion;

a handle portion; and a first hinge connecting said front portion to said handle portion;

said front portion including a second hinge defining a guard portion of said front portion, said second hinge being substantially parallel to said first hinge; and, said handle portion including a blade portion adapted to receive and retain a blade.

24. The scraper of claim 23 wherein:

said handle portion has a top face and a bottom face;

said first hinge permits said front portion to fold in a first direction towards the bottom face of said handle portion;

said second hinge permits said guard portion to fold in a second direction towards the top face of said handle portion; and said blade portion is adapted to retain and receive a blade on the top face of said handle portion.

* * * * *